US010118787B2

(12) United States Patent
Kotani

(10) Patent No.: US 10,118,787 B2
(45) Date of Patent: Nov. 6, 2018

(54) SHEET DISCHARGE DEVICE AND IMAGE FORMING APPARATUS

(71) Applicant: KYOCERA Document Solutions Inc., Osaka-shi, Osaka (JP)

(72) Inventor: Takashi Kotani, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/796,468

(22) Filed: Oct. 27, 2017

(65) Prior Publication Data

US 2018/0179011 A1 Jun. 28, 2018

(30) Foreign Application Priority Data

Dec. 27, 2016 (JP) ..... 2016-253027

(51) Int. Cl.

| | |
|---|---|
| ***B65H 31/18*** | (2006.01) |
| ***B65H 31/10*** | (2006.01) |
| ***B65H 43/08*** | (2006.01) |
| ***B65H 29/14*** | (2006.01) |
| ***B65H 29/22*** | (2006.01) |

(Continued)

(52) U.S. Cl.

CPC ..... *B65H 31/18* (2013.01); *B65H 29/14* (2013.01); *B65H 29/22* (2013.01); *B65H 31/02* (2013.01); *B65H 31/10* (2013.01); *B65H 43/06* (2013.01); *B65H 43/08* (2013.01); *B65H 2301/4212* (2013.01); *B65H 2301/4213* (2013.01); *B65H 2405/11151* (2013.01); *B65H 2405/353* (2013.01); *B65H 2511/11* (2013.01); *B65H 2511/152* (2013.01); *B65H 2511/20* (2013.01);

(Continued)

(58) Field of Classification Search

CPC ... B65H 7/00; B65H 7/02; B65H 7/04; B65H 7/14; B65H 29/125; B65H 29/14; B65H 29/22; B65H 31/00; B65H 31/04; B65H 31/08; B65H 31/10; B65H 31/12; B65H 31/18; B65H 43/00; B65H 43/02; B65H 43/06; B65H 43/08; B65H 2405/353; B65H 2511/152

See application file for complete search history.

(56) References Cited

U.S. PATENT DOCUMENTS 6,375,181 B1 * 4/2002 Kawano ..... B65H 29/58 270/58.12
2001/0050459 A1 * 12/2001 Tamura ..... B65H 29/22 271/217

(Continued)

FOREIGN PATENT DOCUMENTS

JP 2000219409 A * 8/2000 ..... B65H 31/10
JP 2013155034 A 8/2013

*Primary Examiner* — Prasad V Gokhale
(74) *Attorney, Agent, or Firm* — Alleman Hall Creasman & Tuttle LLP

(57) ABSTRACT

In a sheet discharge device, upon a discharge of a sheet bundle onto a discharge tray, a lowering control portion lowers the discharge tray by a predetermined lowering distance. After the discharge tray is lowered by the lowering control portion, a lifting control portion waits until a front end of an initial sheet of a next sheet bundle becomes in a state of protruding from a discharge port, and then lifts the discharge tray until an upper-surface detection sensor detects that an upper surface of sheet bundles stacked on the discharge tray has reached a predetermined height.

4 Claims, 8 Drawing Sheets

(51) Int. Cl.
*B65H 43/06* (2006.01)
*B65H 31/02* (2006.01)

(52) U.S. Cl.
CPC .. *B65H 2511/51* (2013.01); *B65H 2601/2525* (2013.01); *B65H 2801/06* (2013.01)

(56) References Cited

U.S. PATENT DOCUMENTS

2009/0200736 A1* 8/2009 Seki ..... B65H 29/125
271/314
2009/0267290 A1* 10/2009 Kotani ..... B65H 31/10
271/220
2013/0193637 A1* 8/2013 Taguchi ..... G03G 15/6544
271/207
2015/0353314 A1* 12/2015 Wada ..... B65H 29/125
271/176
2017/0305701 A1* 10/2017 Kotani ..... B65H 31/10

* cited by examiner

SHEET DISCHARGE DEVICE AND IMAGE FORMING APPARATUS

INCORPORATION BY REFERENCE

This application is based upon and claims the benefit of priority from the corresponding Japanese Patent Application No. 2016-253027 filed on Dec. 27, 2016, the entire contents of which are incorporated herein by reference.

BACKGROUND

The present disclosure relates to a sheet discharge device including a discharge tray that can be lifted and lowered, and to an image forming apparatus.

There is known a paper sheet discharge device that, after a paper sheet is discharged onto a paper sheet discharge tray, lowers the paper sheet discharge tray once, and then lifts the paper sheet discharge tray to a position where an upper surface portion of paper sheets stacked on the paper sheet discharge tray is detected by an upper surface detection sensor.

SUMMARY

A sheet discharge device according to an aspect of the present disclosure includes a sheet conveying portion, a discharge port, a sheet storage portion, a sheet discharge portion, a discharge tray, a tray lifting/lowering mechanism, an upper-surface detection sensor, a lowering control portion, and a lifting control portion. The sheet conveying portion conveys sheets one by one. The sheets are discharged through the discharge port. The sheet storage portion stores in a stack a plurality of sheets that have been conveyed by the sheet conveying portion, in a state where front ends of the plurality of sheets protrude from the discharge port. The sheet discharge portion discharges, as a sheet bundle, a predetermined number of sheets from the sheet storage portion through the discharge port. On the discharge tray, sheet bundles discharged through the discharge port are stacked. The tray lifting/lowering mechanism supports the discharge tray in such a way as to lift and lower the discharge tray. The upper-surface detection sensor detects whether or not an upper surface of the sheet bundles stacked on the discharge tray has reached a predetermined height. The lowering control portion, upon a discharge of a sheet bundle onto the discharge tray, controls the tray lifting/lowering mechanism to lower the discharge tray by a predetermined lowering distance. The lifting control portion, after the discharge tray is lowered by the lowering control portion, waits until a front end of an initial sheet of a next sheet bundle becomes in a state of protruding from the discharge port, and then lifts the discharge tray until the upper-surface detection sensor detects that the upper surface of the sheet bundles has reached the predetermined height.

An image forming apparatus according to another aspect of the present disclosure includes an image forming portion and the sheet discharge device. The image forming portion forms an image on a sheet. The sheet discharge device discharges the sheet on which the image has been formed by the image forming portion.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

An image forming apparatus 1 according to the embodiment of the present disclosure is a multifunction peripheral having a plurality of functions such as a printer function, a scanner function, and a facsimile function. It is noted that the image forming apparatus 1 is not limited to a multifunction peripheral, but may be a printer, a facsimile, a copier or the like.

Figure 1:
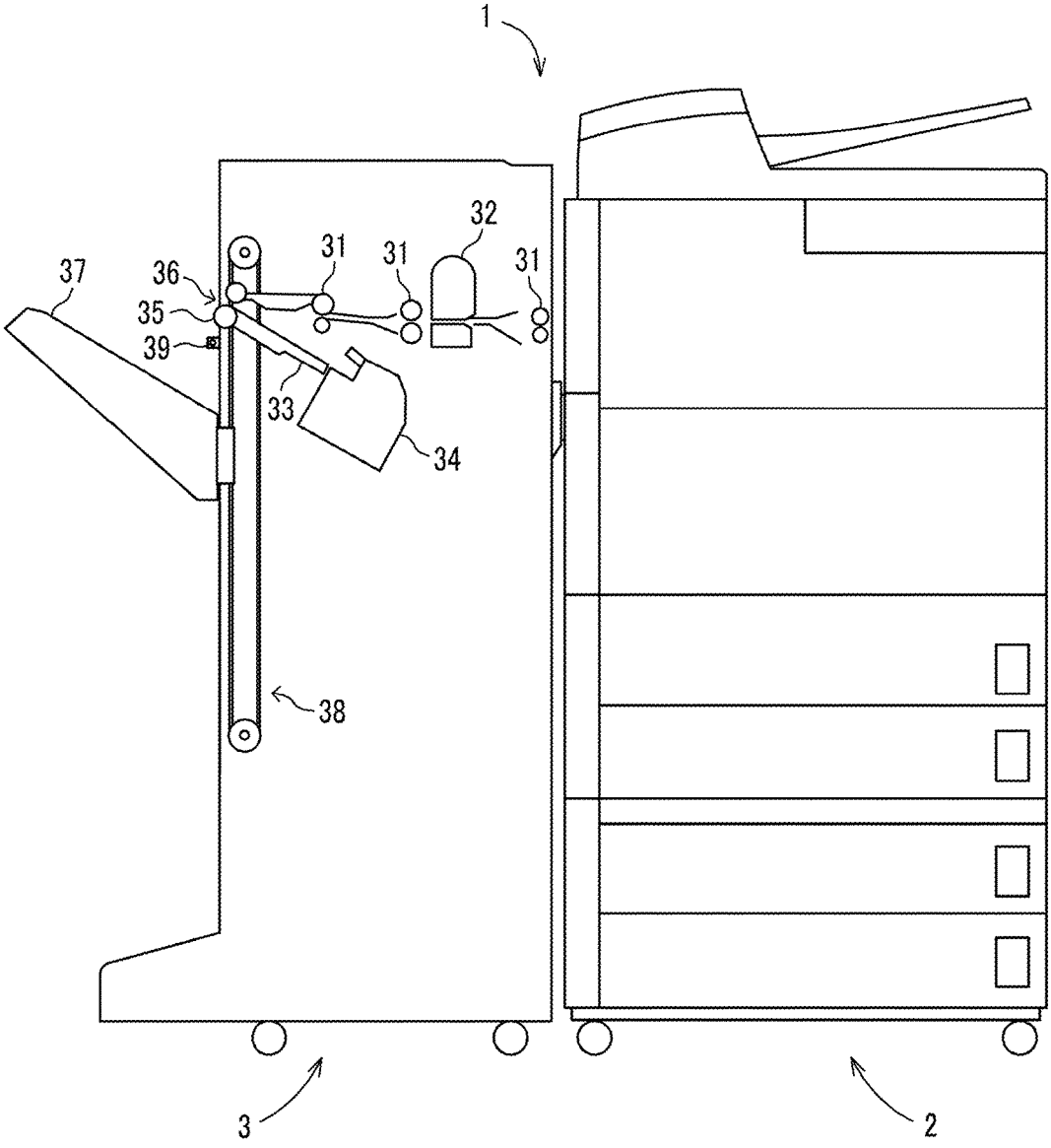
FIG. 1 is a diagram showing a configuration of an image forming apparatus according to an embodiment of the present disclosure.

As shown in FIG. 1, the image forming apparatus 1 according to the embodiment of the present disclosure includes an apparatus main body 2 and a post-processing device 3 (an example of the "sheet discharge device" of the present disclosure). The post-processing device 3 is coupled with a side surface of the apparatus main body 2 in a detachable manner.

Figure 2:
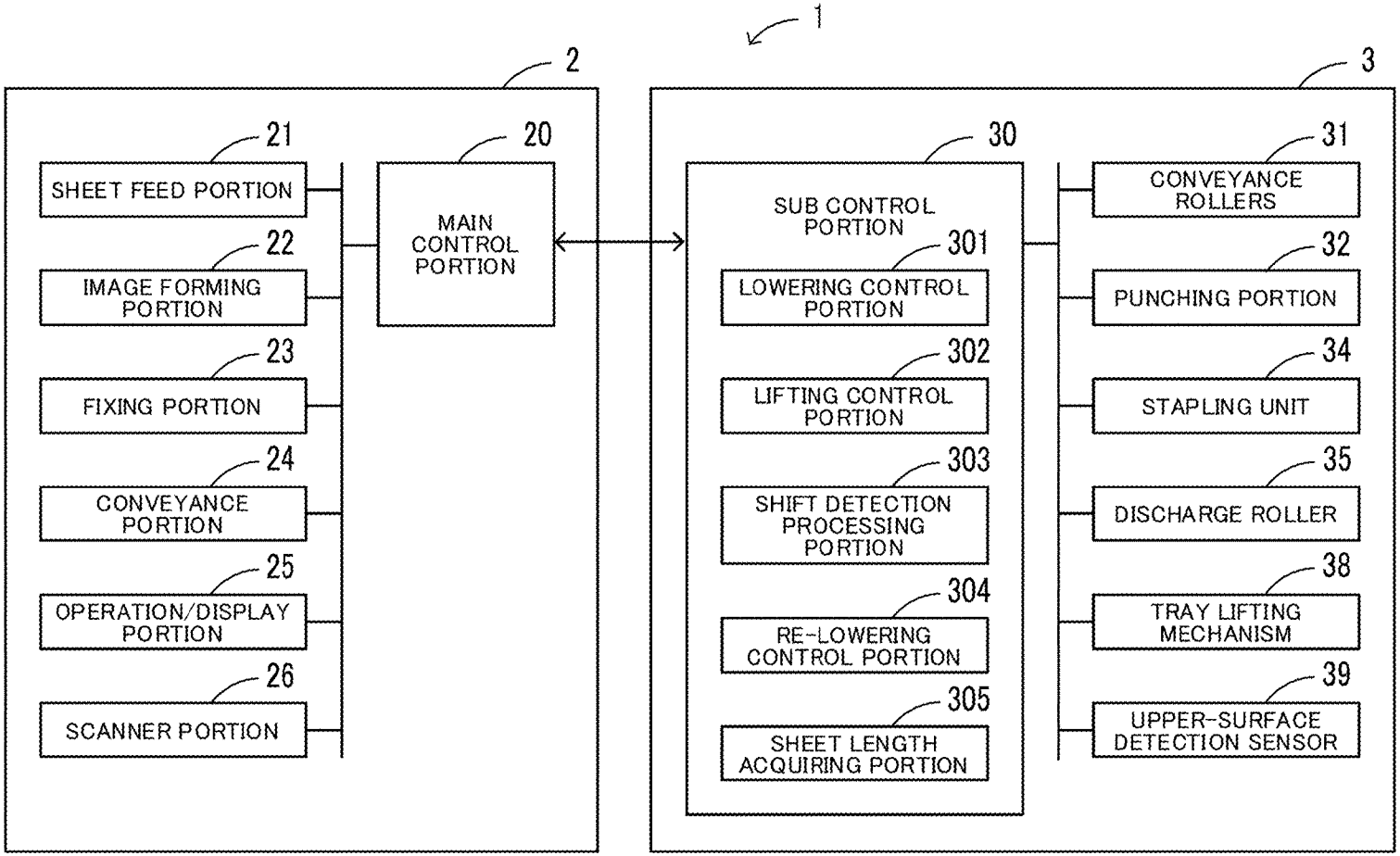
FIG. 2 is a block diagram showing a system configuration of the image forming apparatus according to the embodiment of the present disclosure.

As shown in FIG. 2, the apparatus main body 2 includes a sheet feed portion 21, an image forming portion 22, a fixing portion 23, a conveyance portion 24, an operation/display portion 25, and a scanner portion 26. The apparatus main body 2 is configured to form an image on a sheet P based on image data input from outside via a network communication portion (not shown), or image data read by the scanner portion 26.

The sheet feed portion 21 feeds a sheet P stored in a sheet feed cassette toward the image forming portion 22. The image forming portion 22 includes a photoconductor drum, a charging portion, a developing portion, an exposure portion, a transfer portion, and a cleaning portion, and forms an image on the sheet P by an electrophotographic system. The fixing portion 23 includes a heating roller and a pressure roller, and by using the heating roller and the pressure roller, fuses toner that forms a toner image, and fixes the toner to the sheet P.

The sheet P that has passed through the fixing portion 23 is conveyed to the post-processing device 3 by conveyance rollers included in the conveyance portion 24. The post-processing device 3 performs post-processing such as punching, stapling, or sorting of sheets P on which images have been formed by the image forming portion 22, and then discharges the sheets P.

As shown in FIG. 1 and FIG. 2, the post-processing device 3 includes conveyance rollers 31 (an example of the "sheet conveying portion" of the present disclosure), a punching portion 32, a stack tray 33 (an example of the "sheet storage portion" of the present disclosure), a stapling unit 34, a discharge roller 35 (an example of the "sheet discharge portion" of the present disclosure), a discharge port 36, a discharge tray 37, a tray lifting/lowering mechanism 38, and an upper-surface detection sensor 39.

The conveyance rollers 31 receive a driving force from a motor (not shown) and convey, one by one, sheets P discharged from the apparatus main body 2. A sheet P discharged from the apparatus main body 2 passes through an entry port provided in a housing of the post-processing device 3 so as to be guided into the post-processing device 3 and is conveyed to the punching portion 32 by the conveyance rollers 31. The punching portion 32 is configured to punch the sheet P as specified.

The sheet P that has passed through the punching portion 32 is conveyed to the stack tray 33 by the conveyance rollers 31. The stack tray 33 has a sheet placing surface that extends diagonally downward from a vicinity of the discharge port 36. The stack tray 33 is used to temporarily hold sheets P for the stapling or the sorting.

Figure 3A:
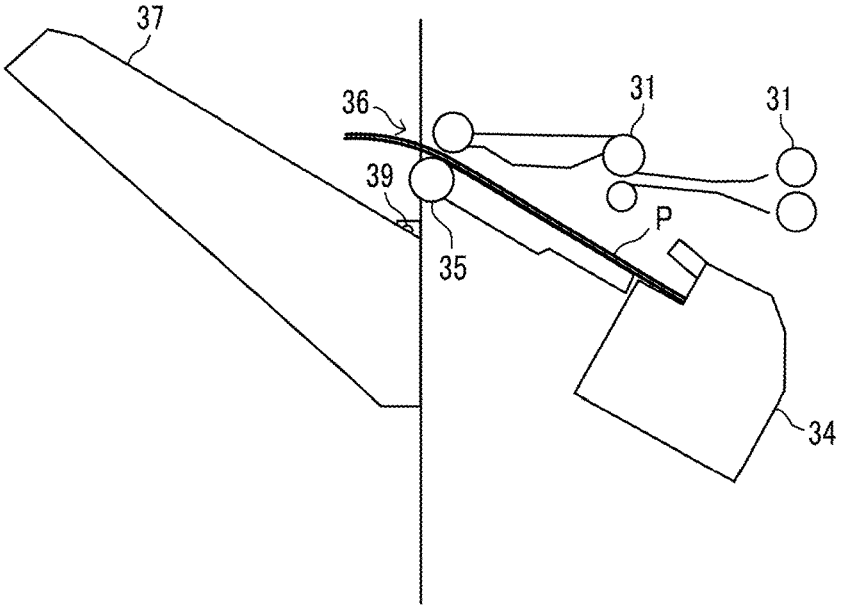
FIG. 3A is a diagram for explaining a lifting/lowering operation of a discharge tray in the image forming apparatus according to the embodiment of the present disclosure.

When the sheet P is conveyed to the stack tray 33 by the conveyance rollers 31, a front end (an end on the downstream side in the conveyance direction) of the sheet P proceeds to the discharge port 36 along the sheet placing surface of the stack tray 33, and protrudes from the discharge port 36 to outside of the housing of the post-processing device 3. Subsequently, after a rear end (an end on the upstream side in the conveyance direction) of the sheet P passes through the conveyance rollers 31, the sheet P slides, by its own weight, diagonally downward along the sheet placing surface of the stack tray 33 and moves to the stapling unit 34 side. The sheet P stops at a position where the rear end of the sheet P abuts on a stopper (not shown). In this way, the stack tray 33 holds, in a stack, a plurality of sheets P that have been conveyed by the conveyance rollers 31, in a state where the front ends of the sheets P protrude from the discharge port 36 (see FIG. 3A).

When the stapling is executed by the post-processing device 3, the stapling unit 34 performs the stapling on the plurality of sheets P that are held by the stack tray 33 as described above.

The discharge roller 35 is provided in a vicinity of the discharge port 36. The discharge roller 35 discharges a predetermined number of sheets P as a sheet bundle B from the stack tray 33 through the discharge port 36. The sheet bundle B discharged through the discharge port 36 is stacked on the discharge tray 37 (see FIG. 3B).

The discharge tray 37 is supported by the tray lifting/lowering mechanism 38 so as to be lifted and lowered. The tray lifting/lowering mechanism 38 includes, for example, two pulleys and a belt which is stretched between the two pulleys, receives a driving force from a motor (not shown) and lifts and lowers the discharge tray 37.

The upper-surface detection sensor 39 is provided below the discharge port 36, and detects whether or not an upper surface of the sheet bundles B stacked on the discharge tray 37 has reached a predetermined height. The upper-surface detection sensor 39 may be a mechanical sensor or an optical sensor. The height of the discharge tray 37 is controlled based on the detection result of the upper-surface detection sensor 39. Specifically, in a case where the sheet bundle B is not stacked on the discharge tray 37, the height of the discharge tray 37 is controlled so that an upper surface (a sheet placing surface) of the discharge tray 37 is at the predetermined height. In addition, in a case where one or more sheet bundles B are stacked on the discharge tray 37, the height of the discharge tray 37 is controlled so that an upper surface of a top sheet bundle B of the stacked sheet bundles B is at the predetermined height. In this way, the height of the discharge tray 37 is controlled in accordance with the height of the upper surface of the sheet bundles B stacked on the discharge tray 37. As a result, the sheet bundles B stacked on the discharge tray 37 are prevented from colliding with a sheet bundle B discharged from the discharge port 36.

As shown in FIG. 2, the apparatus main body 2 includes a main control portion 20 in addition to the above-described components. The post-processing device 3 includes a sub control portion 30 in addition to the above-described components.

The main control portion 20 is a microcomputer configured to control the image forming apparatus 1 comprehensively.

The sub control portion 30 includes control equipment such as a CPU, a ROM, and a RAM. The CPU is a processor that executes various calculation processes. The ROM is a nonvolatile storage portion in which various information such as control programs for causing the CPU to execute various processes are stored in advance. The RAM is a volatile or nonvolatile storage portion that is used as a temporary storage memory (working area) for the various processes executed by the CPU. The main control portion 20 and the sub control portion 30 can communicate with each other.

Specifically, the sub control portion 30 includes a lowering control portion 301, a lifting control portion 302, a shift detection processing portion 303, a re-lowering control portion 304, and a sheet length acquiring portion 305. It is noted that the sub control portion 30 functions as processing portions by executing various processes in accordance with the control programs. In addition, the sub control portion 30 may include an electronic circuit that realizes one or more processing functions of the processing portions.

Figure 3B:
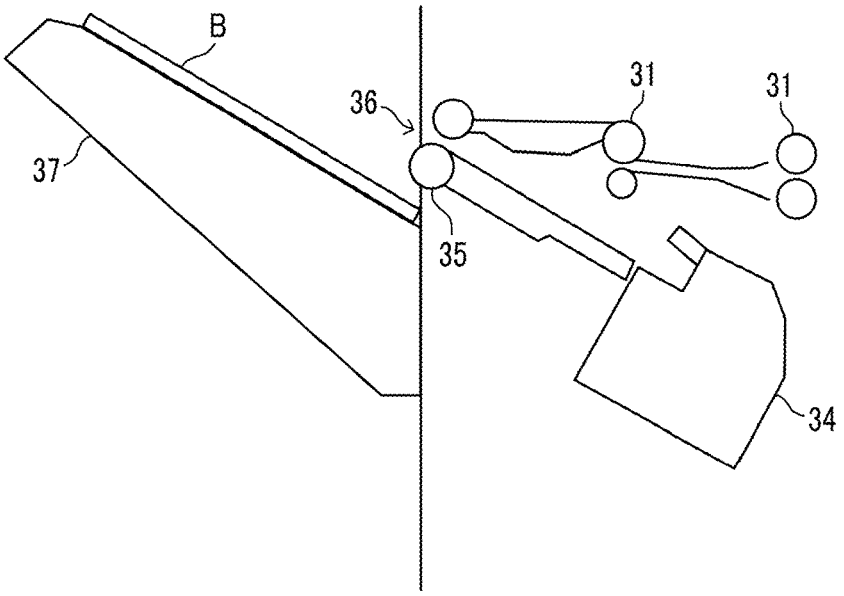
FIG. 3B is a diagram for explaining the lifting/lowering operation of the discharge tray in the image forming apparatus according to the embodiment of the present disclosure.
Figure 3C:
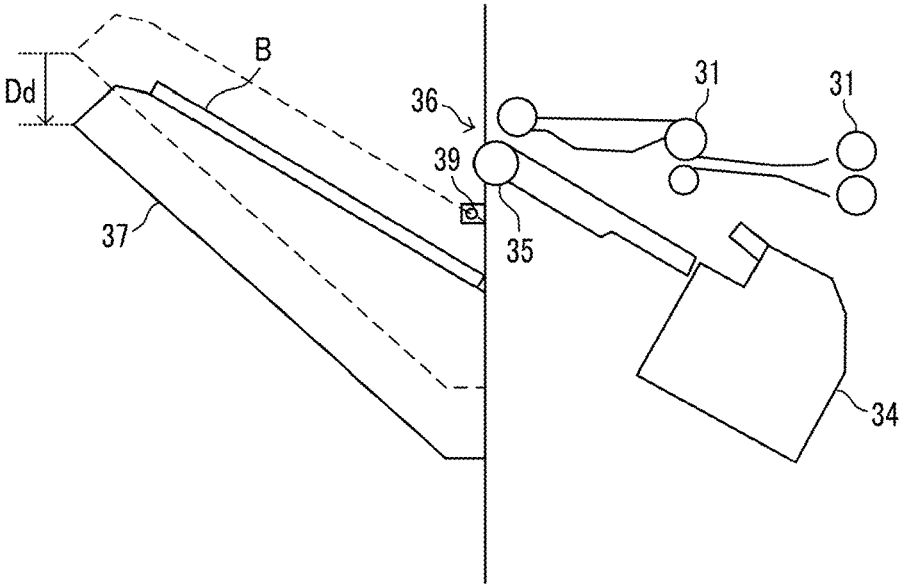
FIG. 3C is a diagram for explaining the lifting/lowering operation of the discharge tray in the image forming apparatus according to the embodiment of the present disclosure.

The lowering control portion 301, upon a discharge of a sheet bundle B onto the discharge tray 37, controls the tray lifting/lowering mechanism 38 to lower the discharge tray 37 by a predetermined lowering distance Dd (see FIG. 3C). It is noted that the lowering control portion 301 may lower the discharge tray 37 by the lowering distance Dd by lowering the discharge tray 37 for a predetermined lowering time period. With a configuration where the discharge tray 37 is lowered by a sufficient lowering distance after a sheet bundle B is discharged onto the discharge tray 37, if, for example, the rear end of the sheet bundle B is hooked on the discharge port 36, the rear end is separated from the discharge port 36, and the sheet bundle B is stacked on the discharge tray 37 correctly.

Figure 3D:
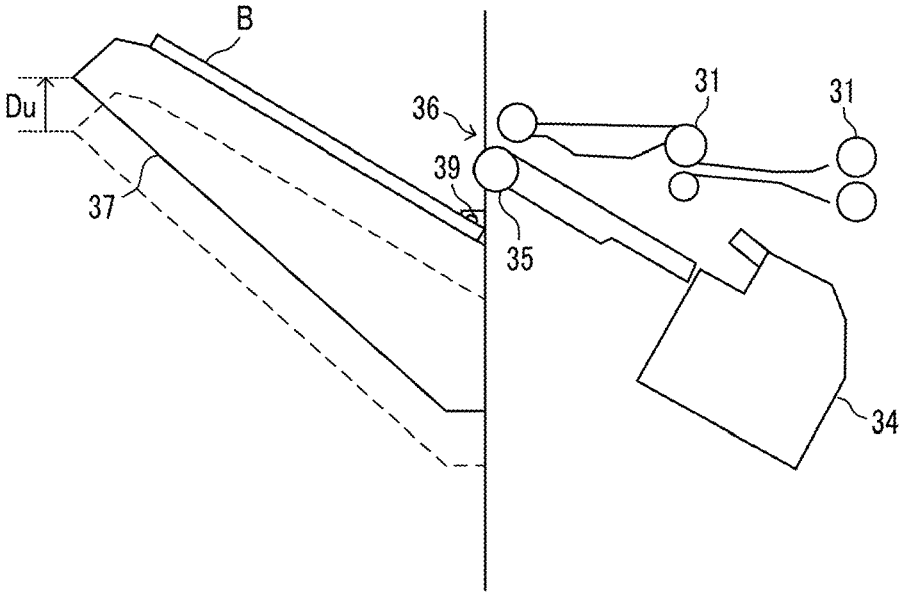
FIG. 3D is a diagram for explaining the lifting/lowering operation of the discharge tray in the image forming apparatus according to the embodiment of the present disclosure.

The lifting control portion 302, after the discharge tray 37 is lowered by the lowering control portion 301, controls the tray lifting/lowering mechanism 38 to lift the discharge tray 37 until the upper-surface detection sensor 39 detects that the upper surface of the sheet bundles B has reached the predetermined height (see FIG. 3D). This makes it possible to receive, at an appropriate height, a sheet bundle B that is discharged next from the discharge port 36.

Figure 4A:
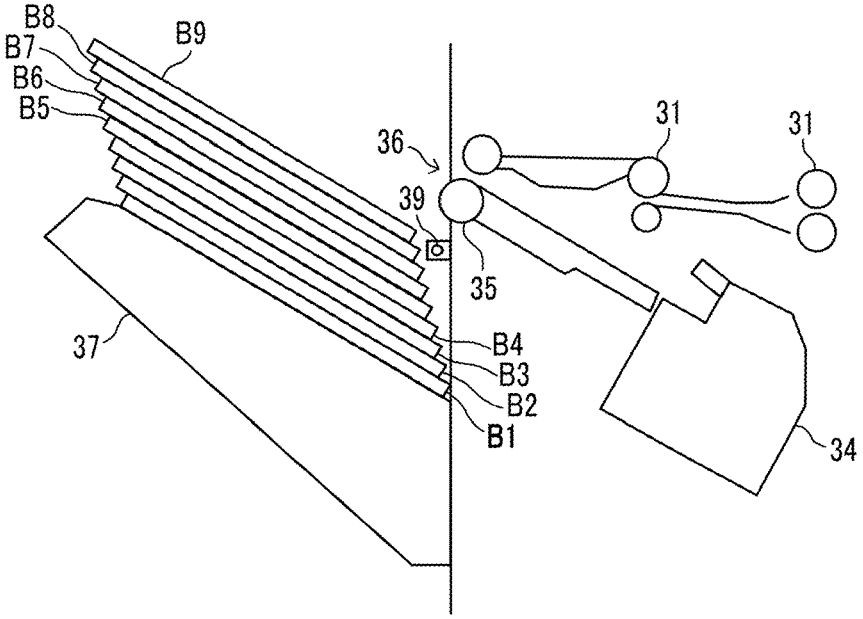
FIG. 4A is a diagram for explaining a lifting/lowering operation of a discharge tray in a comparative example.
Figure 4B:
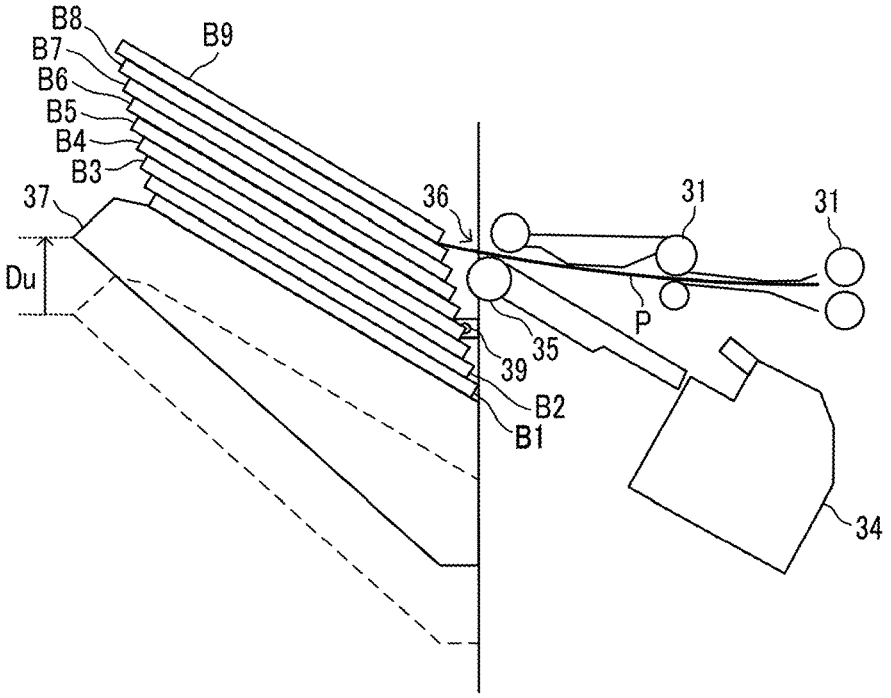
FIG. 4B is a diagram for explaining the lifting/lowering operation of the discharge tray in the comparative example.

Meanwhile, in the post-processing device 3, the sheet bundles B stacked on the discharge tray 37 may be positionally shifted, and the upper surface of the sheet bundles B may be shifted from a detectable range of the upper-surface detection sensor 39. For example, in a comparative example shown in FIG. 4A, in sheet bundles B1 to B9 stacked on the discharge tray 37, the upper a sheet bundle B is, the more it is shifted leftward (toward the downstream side in the conveyance direction). Such a shift of the sheet bundles B may be generated by curling of each sheet bundles B or the like. In that case, the upper surface of the sheet bundles B stacked on the discharge tray 37 becomes higher than the discharge port 36, and a sheet P that comes out of the discharge port 36 next may collide with the sheet bundles B stacked on the discharge tray 37. For example, in the comparative example shown in FIG. 4A, since the discharge tray 37 is lifted until the upper-surface detection sensor 39 detects that the upper surface of the sheet bundle B4 has reached the predetermined height, the upper surface of the sheet bundle B9 at the top of the stack becomes higher than the discharge port 36, as shown in FIG. 4B. As a result, as shown in FIG. 4B, a sheet P that comes out of the discharge port 36 collides with the sheet bundles B stacked on the discharge tray 37. This may result in a sheet jam. On the other hand, according to the image forming apparatus 1 of the present embodiment, with a configuration and operation described below, it is possible to prevent a sheet P that comes out of the discharge port 36 from colliding with sheet bundles B stacked on the discharge tray 37.

Figure 5A:
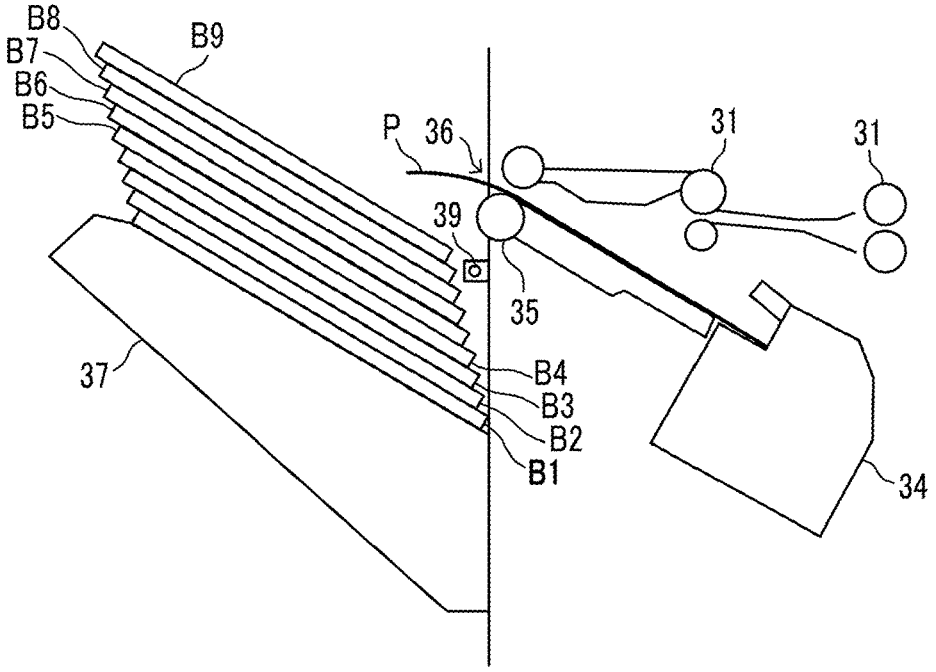
FIG. 5A is a diagram for explaining a lifting/lowering operation of the discharge tray in the image forming apparatus according to the embodiment of the present disclosure.
Figure 5B:
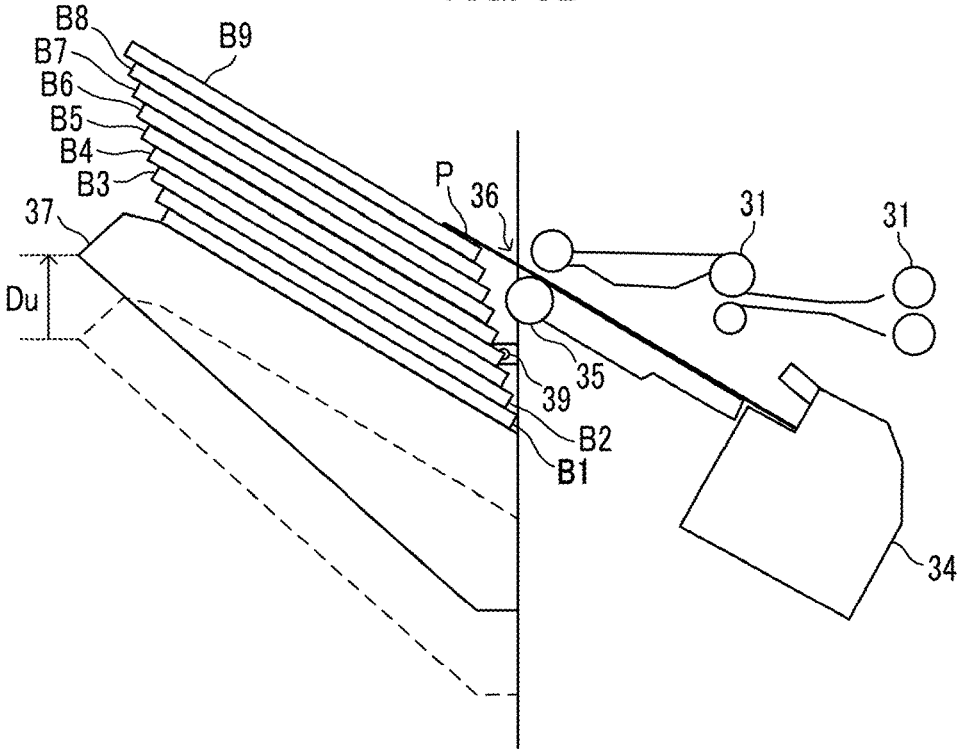
FIG. 5B is a diagram for explaining the lifting/lowering operation of the discharge tray in the image forming apparatus according to the embodiment of the present disclosure.

Specifically, the lifting control portion 302 is configured to, after the discharge tray 37 is lowered by the lowering control portion 301, wait until the front end of the initial sheet P of the next sheet bundle B becomes in a state of protruding from the discharge port 36, and then lift the discharge tray 37 until the upper-surface detection sensor 39 detects that the upper surface of the sheet bundles B has reached the predetermined height. For example, as shown in FIG. 5A, after the sheet bundle B9 is discharged onto the discharge tray 37, and the discharge tray 37 is lowered by the lowering control portion 301, the lifting control portion 302 waits until the front end of the initial sheet P of the next sheet bundle B (namely, a sheet bundle B that is discharged following the sheet bundle B9) becomes in a state of protruding from the discharge port 36, and then lifts the discharge tray 37. With this configuration, as shown in FIG. 5B, the front end of the initial sheet P of the next sheet bundle B is lifted by the upper surface of the sheet bundle B9, which is at the top of the sheet bundles B stacked on the discharge tray 37, and is supported by the upper surface of the sheet bundle B9. With this configuration, the initial sheet P, the second sheet P and onward of the next sheet bundle B are prevented from colliding with the sheet bundles B stacked on the discharge tray 37.

Figure 6A:
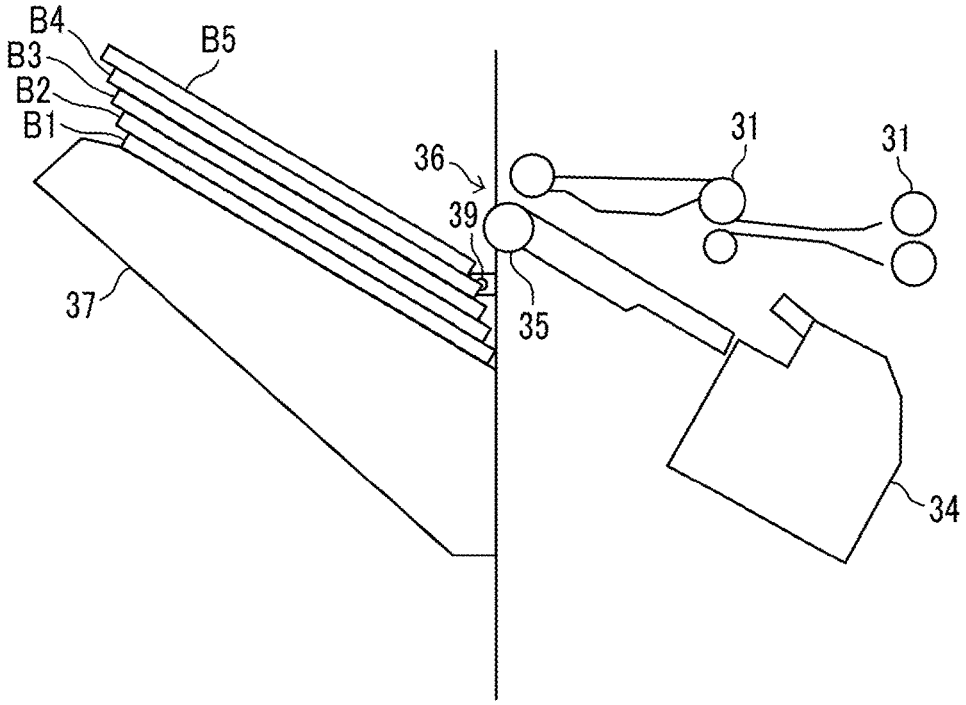
FIG. 6A is a diagram for explaining a lifting/lowering operation of the discharge tray in the image forming apparatus according to the embodiment of the present disclosure.

The shift detection processing portion 303 detects whether or not the upper surface of the sheet bundles B is shifted from the detectable range of the upper-surface detection sensor 39. Specifically, the shift detection processing portion 303 calculates a lifting distance Du by which the discharge tray 37 was lifted by the lifting control portion 302. The lifting distance Du of the discharge tray 37 is calculated by multiplying the lifting speed by the lifting time period. The shift detection processing portion 303 then detects whether or not the upper surface of the sheet bundles B is shifted from the detectable range of the upper-surface detection sensor 39, based on a result of comparison between the lowering distance Dd by which the discharge tray 37 was lowered by the lowering control portion 301 and the lifting distance Du by which the discharge tray 37 was lifted by the lifting control portion 302. For example, in a case where a sheet bundle B discharged from the discharge port 36 is stacked at a correct position on the discharge tray 37 as shown in FIG. 3B, the lifting distance Du is smaller than the lowering distance Dd by the thickness of the discharged sheet bundle B. For example, the height of the discharge tray 37 shown in FIG. 3D is lower than the height of the discharge tray 37 shown in FIG. 3A by the thickness of the sheet bundle B. On the other hand, in a case where, like a sheet bundle B5 shown in FIG. 6A, the upper surface of the sheet bundles B discharged from the discharge port 36 is shifted from the detectable range of the upper-surface detection sensor 39, the lifting distance Du is approximately the same as the lowering distance Dd. Accordingly, when a result of subtracting the lifting distance Du from the lowering distance Dd is out of a predetermined range (for example, a range from a first threshold that is greater than 0, to a second threshold that is greater than the first threshold), it is determined that the upper surface of the sheet bundles B is shifted from the detectable range of the upper-surface detection sensor 39.

It is noted that when the shift detection processing portion 303 has detected a shift of sheet bundles B, the lifting control portion 302 may wait until the front end of the initial sheet P of a sheet bundle B discharged next becomes in a state of protruding from the discharge port 36, and then lift the discharge tray 37. On the other hand, when the shift detection processing portion 303 has not detected a shift of sheet bundles B, the lifting control portion 302 may lift the discharge tray 37 without waiting until the front end of the initial sheet P of the sheet bundle B discharged next becomes in a state of protruding from the discharge port 36. This is because in a state where a shift of sheet bundles B has not been detected by the shift detection processing portion 303, there is a low possibility that the upper surface of the sheet bundles B stacked on the discharge tray 37 becomes higher than the discharge port 36. In addition, when a length (length in the conveyance direction) of the sheet P is large, if the height of the discharge tray 37 is too low, the front end of the sheet P protruding from the discharge port 36 may hang down low from the discharge port 36, be curled, and not be discharged correctly. Accordingly, to prevent occurrence of such a problem, in a case where the shift detection processing portion 303 has not detected a shift of sheet bundles B, the lifting control portion 302 may lift the discharge tray 37 without waiting until the front end of the initial sheet P of the sheet bundle B discharged next becomes in a state of protruding from the discharge port 36.

Figure 6B:
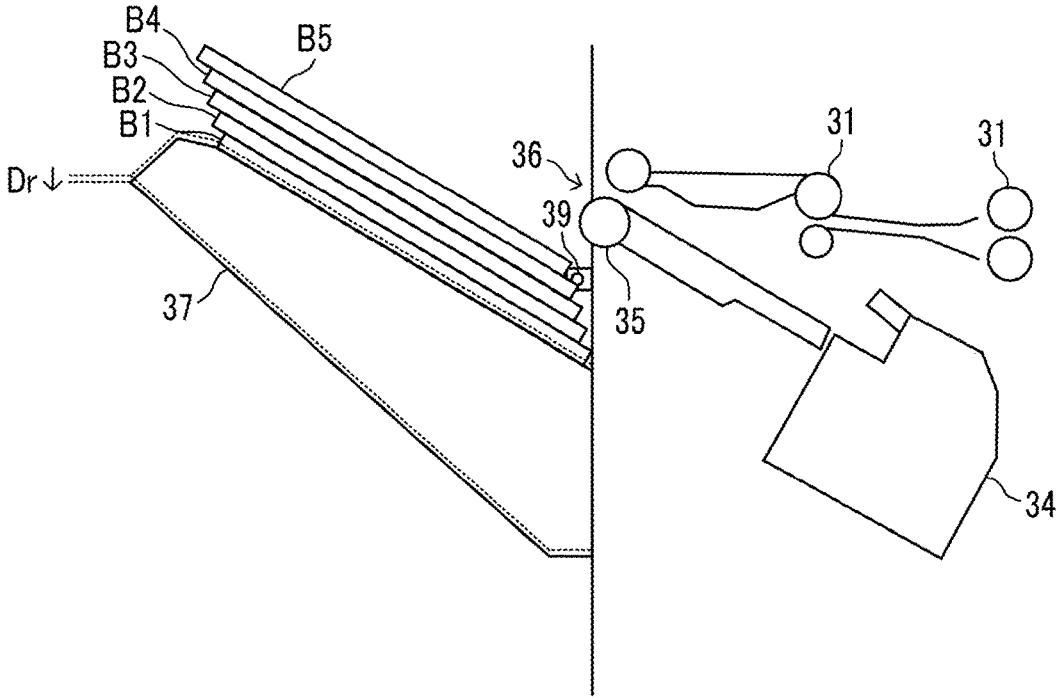
FIG. 6B is a diagram for explaining the lifting/lowering operation of the discharge tray in the image forming apparatus according to the embodiment of the present disclosure.

In a case where the shift detection processing portion 303 has detected a shift of sheet bundles B, after the lifting control portion 302 lifts the discharge tray 37, the re-lowering control portion 304 lowers the discharge tray 37 again by a predetermined re-lowering distance Dr (see FIG. 6B). For example, as in the sheet bundle B5 shown in FIG. 6A, when the upper surface of sheet bundles B discharged from the discharge port 36 is shifted from the detectable range of the upper-surface detection sensor 39, the height of the discharge tray 37 after a lift by the lifting control portion 302 becomes higher than an original height at which the discharge tray 37 should be. As a result, in such a case, in order to make the height of the discharge tray 37 close to the original height at which the discharge tray 37 should be, after the discharge tray 37 is lifted by the lifting control portion 302, the re-lowering control portion 304 lowers the discharge tray 37 again by the re-lowering distance Dr. It is noted that the re-lowering distance Dr is an arbitrary distance larger than 0 (zero). With this configuration, even when the upper surface of the sheet bundles B is shifted from the detectable range of the upper-surface detection sensor 39, it is possible to prevent the height of the upper surface of the sheet bundles B from becoming higher than the discharge port 36. It is noted that the re-lowering control portion 304 may lower the discharge tray 37 by the re-lowering distance Dr by lowering the discharge tray 37 by a predetermined re-lowering time period.

It is noted that even in a case where the re-lowering control portion 304 performs a re-lowering of the discharge tray 37, there may be a case where the height of the upper surface of the sheet bundles B is temporarily higher than the discharge port 36 during a time period after the discharge tray 37 is lifted by the lifting control portion 302 and before the discharge tray 37 is lowered by the re-lowering control portion 304. However, even in this case, the lifting control portion 302 waits until the front end of the initial sheet P of the next sheet bundle B becomes in a state of protruding from the discharge port 36, and lifts the discharge tray 37. It is thus possible to prevent a sheet P coming out of the discharge port 36 from colliding with the sheet bundles B stacked on the discharge tray 37.

The sheet length acquiring portion 305 acquires a length of the sheet P in the conveyance direction thereof as a sheet length. For example, the sheet length acquiring portion 305 acquires the sheet length from the main control portion 20. Alternatively, the sheet length acquiring portion 305 may calculate the sheet length based on signals from a plurality of sheet sensors (not shown) provided along the conveyance direction of the sheet P. In a case where the sheet length of the initial sheet P of the sheet bundle B that is discharged next, is smaller than a predetermined threshold, the lifting control portion 302 may always wait until the front end of the initial sheet P of the next sheet bundle B becomes in a state of protruding from the discharge port 36 and then lift the discharge tray 37 regardless of the detection result of the shift detection processing portion 303. On the other hand, in a case where the sheet length of the initial sheet P of the sheet bundle B that is discharged next, is equal to or larger than the threshold, the lifting control portion 302 may wait until the front end of the initial sheet P of the next sheet bundle B becomes in a state of protruding from the discharge port 36 and then lift the discharge tray 37 only if the shift detection processing portion 303 detects a shift of the sheet bundles B. With this configuration, in a case where the sheet length is small, it is possible to prevent, in a reliable manner, a sheet P coming out of the discharge port 36 from colliding with the sheet bundles B stacked on the discharge tray 37. In addition, in a case where the sheet length is large, the discharge tray 37 is lifted without waiting until the front end of the initial sheet P of the sheet bundle B discharged next becomes in a state of protruding from the discharge port 36, while a shift of the sheet bundles B has not been detected by the shift detection processing portion 303. This makes it possible to suppress the sheet bundle B that is discharged next, from not being discharged appropriately.

In the following, an example of the procedure of a tray lifting/lowering process executed by the sub control portion 30 is described with reference to FIG. 7. Here, steps S1, S2, . . . represent numbers assigned to the processing procedures (steps) executed by the sub control portion 30. It is noted that the tray lifting/lowering process is, for example, started in response to a power-on of the image forming apparatus 1, and is ended in response to a power-off of the image forming apparatus 1.

<Step S1>

First, in step S1, the sub control portion 30 determines whether or not a sheet bundle B has been discharged from the discharge port 36. For example, the sub control portion 30 determines whether or not a sheet bundle B has been discharged from the discharge port 36 based on signals from sheet sensors (not shown) provided in the vicinity of the discharge port 36. When it is determined that a sheet bundle B has been discharged (S1: Yes), the process moves to step S2. On the other hand, when it is determined that a sheet bundle B has not been discharged (S1: No), the process of step S1 is repeated until it is determined that a sheet bundle B has been discharged.

<Step S2>

In step S2, the sub control portion 30 (the lowering control portion 301) lowers the discharge tray 37 by the predetermined lowering distance Dd. With this configuration, even in a case where the rear end of the sheet bundle B is hooked on the discharge port 36, the rear end of the sheet bundle B is separated from the discharge port 36, and the sheet bundle B is stacked on the discharge tray 37 correctly.

<Step S3>

In step S3, the sub control portion 30 determines whether or not an abnormality flag is on. It is noted that the abnormality flag indicates whether or not the upper surface of the sheet bundles B is shifted from the detectable range of the upper-surface detection sensor 39, and is set on in step S9 and set off in step S7 described below. When it is determined that the abnormality flag is on (S3: Yes), the process moves to step S4. On the other hand, when it is determined that the abnormality flag is off (S3: No), the process moves to step S5.

<Step S4>

In step S4, the sub control portion 30 (the lifting control portion 302) determines whether or not the front end of the initial sheet P of the next sheet bundle B is in a state of protruding from the discharge port 36. For example, the sub control portion 30 determines whether or not the front end of the initial sheet P of the next sheet bundle B is in a state of protruding from the discharge port 36, based on signals from sheet sensors (not shown) provided in the vicinity of the discharge port 36. When it is determined that the front end of the sheet P is in a state of protruding from the discharge port 36 (S4: Yes), the process moves to step S5. On the other hand, when it is determined that the front end of the sheet P is not in a state of protruding from the discharge port 36 (S4: No), the process of step S4 is repeated until it is determined that the front end of the sheet P is in a state of protruding from the discharge port 36.

<Step S5>

In step S5, the sub control portion 30 (the lifting control portion 302) lifts the discharge tray 37 until the upper-surface detection sensor 39 detects that the upper surface of the sheet bundles B has reached the predetermined height.

<Step S6>

In step S6, the sub control portion 30 (the shift detection processing portion 303) determines whether or not the lifting distance Du of the discharge tray 37 in the step S5 is abnormal. Specifically, the sub control portion 30 determines whether or not the lifting distance Du is abnormal based on a result of comparison between the lowering distance Dd by which the discharge tray 37 was lowered in in the step S2, and the lifting distance Du by which the discharge tray 37 was lifted in the step S5. When it is determined that the lifting distance Du is abnormal (S6: Yes), the process moves to step S9. On the other hand, when it is determined that the lifting distance Du is not abnormal (S6: No), the process moves to step S7.

<Step S7>

In step S7, upon determining that the upper surface of the sheet bundles B is not shifted from the detectable range of the upper-surface detection sensor 39, the sub control portion 30 sets off the abnormality flag.

<Step S8>

In step S8, the sub control portion 30 resets an abnormality counter to 0 (zero). It is noted that the abnormality counter is used to count the number of times that it has been determined in step S6 that the lifting distance Du is abnormal. After step S8, the process moves to step S12.

<Step S9>

In step S9, upon determining that the upper surface of the sheet bundles B is shifted from the detectable range of the upper-surface detection sensor 39, the sub control portion 30 sets on the abnormality flag.

<Step S10>

In step S10, the sub control portion 30 increments the abnormality counter.

<Step S11>

In step S11, the sub control portion 30 (the re-lowering control portion 304) lowers the discharge tray 37 again by the re-lowering distance Dr. The process then moves to step S12.

<Step S12>

In step S12, the sub control portion 30 determines whether or not the count value of the abnormality counter is 3. When it is determined that the count value of the abnormality counter is 3 (S12: Yes), the process moves to step S14. On the other hand, when it is determined that the count value of the abnormality counter is not 3 (namely, the count value is any of values 0 to 2) (S12: No), the process moves to step S13.

<Step S13>

In step S13, the sub control portion 30 determines whether or not all of the sheet bundles B have been discharged to the discharge tray 37. When it is determined that all of the sheet bundles B have been discharged to the discharge tray 37 (S13: Yes), the discharge tray 37 is returned to the initial position (FIG. 3A) as necessary, and the process returns to step S1.

<Step S14>

When the count value of the abnormality counter is 3, it means that the upper surfaces of three sheet bundles B continuously discharged from the discharge port 36 are shifted from the detectable range of the upper-surface detection sensor 39. Thus, in step S14, the sub control portion 30 executes a predetermined error process to prevent a sheet P that comes out of the discharge port 36, from colliding with the sheet bundles B stacked on the discharge tray 37. For example, the sub control portion 30 temporarily stops the operation of the post-processing device 3, and displays, on the operation/display portion 25, a message that urges the user to remove the sheet bundles B from the discharge tray 37 (or to arrange the sheet bundles B to correct positions). Thereafter, the discharge tray 37 is returned to the initial position (FIG. 3A) as necessary, and the process returns to step S1.

As described above, according to the present embodiment, after the discharge tray 37 is lowered by the lowering control portion 301, it is waited until the front end of the initial sheet P of the next sheet bundle B becomes in a state of protruding from the discharge port 36, and then the discharge tray 37 is lifted. With this configuration, it is possible to suppress a sheet P coming out of the discharge port 36 from colliding with the sheet bundles B stacked on the discharge tray 37.

Figure 7:
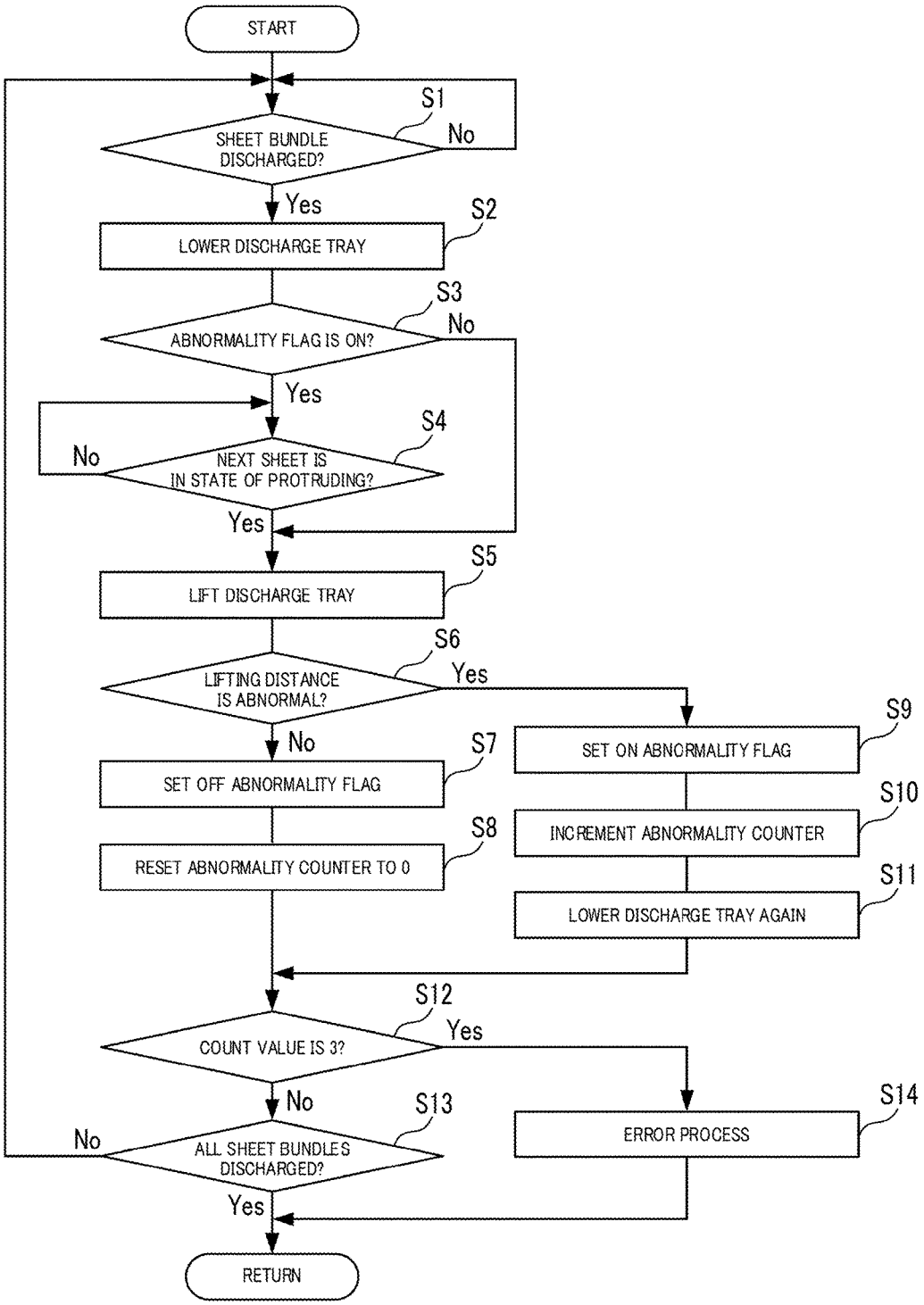
FIG. 7 is a flowchart showing an example of a procedure of a tray lifting/lowering process executed in the image forming apparatus according to the embodiment of the present disclosure.

It is noted that in the flowchart shown in FIG. 7, only in a case where the abnormality flag is on (namely, only in a case where it is detected that the upper surface of the sheet bundles B is shifted from the detectable range of the upper-surface detection sensor 39), it is waited until the front end of the initial sheet P of the next sheet bundle B becomes in a state of protruding from the discharge port 36, and then the discharge tray 37 is lifted. However, the present disclosure is not limited to this configuration. As another embodiment, it may always be waited until the front end of the initial sheet P of the next sheet bundle B becomes in a state of protruding from the discharge port 36, and then the discharge tray 37 may be lifted, regardless of the abnormality flag.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet discharge device comprising:

a sheet conveying portion configured to convey sheets one by one;

a discharge port through which the sheets are discharged;

a sheet storage portion configured to store in a stack a plurality of sheets that have been conveyed by the sheet conveying portion, in a state where front ends of the plurality of sheets protrude from the discharge port;

a sheet discharge portion configured to discharge a plurality of sheet bundles from the sheet storage portion through the discharge port, each sheet bundle including a plurality of sheets;

a discharge tray on which sheet bundles discharged through the discharge port are stacked;

a tray lifting and lowering mechanism supporting the discharge tray in such a way as to lift and lower the discharge tray;

an upper-surface detection sensor configured to detect whether or not an upper surface of the sheet bundles stacked on the discharge tray has reached a predetermined height;

a lowering control portion configured to, upon a discharge of a sheet bundle onto the discharge tray, control the tray lifting and lowering mechanism to lower the discharge tray by a predetermined lowering distance;

a lifting control portion configured to, after the discharge tray is lowered by the lowering control portion, wait until a front end of an initial sheet of a next sheet bundle becomes in a state of protruding from the discharge port as detected by one or more sheet sensors, and then lift the discharge tray until the upper-surface detection sensor detects that the upper surface of the sheet bundles has reached the predetermined height;

a shift detection processing portion configured to detect whether or not the upper surface of the sheet bundles is shifted from a detectable range of the upper-surface detection sensor, wherein in a case where the shift detection processing portion has detected that the upper surface of the sheet bundles is shifted, the lifting control portion waits until the front end of the initial sheet of the next sheet bundle becomes in the state of protruding from the discharge port as detected by the one or more sheet sensors and then lifts the discharge tray; and wherein the shift detection processing portion detects whether or not the upper surface of the sheet bundles is shifted from the detectable range of the upper-surface detection sensor, based on a result of comparison between a lowering distance by which the discharge tray was lowered by the lowering control portion and a lifting distance by which the discharge tray was lifted by the lifting control portion.

2. The sheet discharge device according to claim 1, further comprising:

a sheet length acquiring portion configured to acquire from the one or more sheet sensors a length of a sheet in a conveyance direction thereof as a sheet length, wherein in a case where the sheet length of the initial sheet of the next sheet bundle is smaller than a predetermined threshold, the lifting control portion always waits until the front end of the initial sheet of the next sheet bundle becomes in the state of protruding from the discharge port and then lifts the discharge tray regardless of the detection result of the shift detection processing portion, and in a case where the sheet length of the initial sheet of the next sheet bundle is equal to or larger than the threshold, the lifting control portion waits until the front end of the initial sheet of the next sheet bundle becomes in the state of protruding from the discharge port and then lifts the discharge tray only when the shift detection processing portion detects a shift of the sheet bundles.

3. The sheet discharge device according to claim 1, further comprising:

a re-lowering control portion configured to, in a case where the shift detection processing portion has detected a shift of the sheet bundles and the lifting control portion has lifted the discharge tray, lower the discharge tray again by a predetermined re-lowering distance.

4. An image forming apparatus comprising:

an image forming portion configured to form an image on a sheet; and the sheet discharge device according to claim 1 configured to discharge the sheet on which the image has been formed by the image forming portion.

* * * * *